US010434519B2

(12) United States Patent
Ross et al.

(10) Patent No.: US 10,434,519 B2
(45) Date of Patent: Oct. 8, 2019

(54) SYSTEMS AND METHODS FOR SEPARATING REFUSE

(76) Inventors: Aamon Ross, Tulsa, OK (US); Michael Wells, Hot Springs, AR (US); Dominic Halsmer, Jenks, OK (US); Halsmer Christina, Jenks, OK (US); Chris Barker, Eagle, ID (US); Aron Romasania, Tulsa, OK (US)

( * ) Notice: Subject to any disclaimer, the term of this patent is extended or adjusted under 35 U.S.C. 154(b) by 0 days.

(21) Appl. No.: 13/430,551

(22) Filed: Mar. 26, 2012

(65) Prior Publication Data

US 2012/0241362 A1 Sep. 27, 2012

Related U.S. Application Data

(60) Provisional application No. 61/467,151, filed on Mar. 24, 2011.

(51) Int. Cl.
*B03C 1/22* (2006.01)

(52) U.S. Cl.
CPC ..... *B03C 1/22* (2013.01); *B03C 2201/20* (2013.01)

(58) Field of Classification Search
CPC .... B03C 1/16; B03C 1/18; B03C 1/20; B03C 1/22
USPC ..... 209/218, 223.1, 225, 226
See application file for complete search history.

(56) References Cited

U.S. PATENT DOCUMENTS 4,127,477 A * 11/1978 Schloemann ..... B03C 1/23 209/138
4,134,829 A * 1/1979 Bender et al. ..... 209/223.1
4,842,721 A * 6/1989 Schloemann ..... 209/212
5,101,980 A * 4/1992 Arvidson ..... B65G 23/44 198/807
5,116,486 A 5/1992 Pederson
5,467,866 A * 11/1995 Swinderman ..... B65G 15/62 198/823
5,919,737 A * 7/1999 Broide ..... 505/400
5,931,309 A * 8/1999 Andersson ..... 209/223.1
5,967,330 A 10/1999 Buer
6,230,897 B1 * 5/2001 Exner ..... 209/219
6,279,505 B1 8/2001 Plester et al.
6,318,558 B1 * 11/2001 Exner ..... 209/2
6,599,584 B2 7/2003 Plester et al.
6,920,982 B2 7/2005 Mankosa et al.
7,318,528 B1 * 1/2008 Hessabi ..... 209/215
7,770,735 B2 * 8/2010 Phillip ..... B03C 1/03 209/214

* cited by examiner

*Primary Examiner* — Ernesto A Suarez
(74) *Attorney, Agent, or Firm* — John M. Behles

(57) ABSTRACT

Systems and methods for separating metallically augmented non-magnetic objects are provided herein. Systems may include a conveyor for translating refuse along a path, the refuse comprising non-magnetic objects and metallically augmented non-magnetic objects, and a magnetic force generator extending along at least a portion of the conveyor and generating a magnetic force that causes the metallically augmented non-magnetic objects to remain in contact with the conveyor as the metallically augmented non-magnetic objects traverse along the path and as the non-magnetic objects are removed from conveyor.

5 Claims, 10 Drawing Sheets

SYSTEMS AND METHODS FOR SEPARATING REFUSE

CROSS-REFERENCE TO RELATED APPLICATIONS

This non-provisional patent application claims the benefit of U.S. Provisional Patent Application Ser. No. 61/467,151, filed on Mar. 24, 2011, which is incorporated by reference herein in its entirety.

GOVERNMENT INTERESTS

N/A

BACKGROUND OF THE INVENTION

Field of the Invention

The present invention relates generally to systems and methods for separating refuse, and more specifically, but not by way of limitation to systems and methods for efficiently separating and/or sorting metallically augmented non-magnetic objects, and further to metallically augmenting non-metallic and/or non-magnetic objects.

Related Art

Methods for recycling refuse are well known in the art. Generally speaking, to recycle refuse it must be first separated by refuse type into magnetic and non-magnetic objects. Magnetic objects including both ferrous and non-ferrous metals can be easily sorted from refuse by the use of devices that interact with the magnetic properties of the objects such as magnets and eddy current generators that generate magnetic fields. These devices are efficient and can separate metallic objects with some measure of efficiency and precision. Because metallic objects are often sorted and sold at profit margins much higher than non-magnetic objects, the metallic objects are often sorted from the bulk refuse and all other non-magnetic projects are then transported to a disposal site. This phenomenon is due, in part, to the relatively low profit yield for recycling non-magnetic objects that are caused by at least the following reasons.

In contrast to ferrous and non-ferrous metallic objects, most non-magnetic objects are difficult to sort by type because of a lack of a unique material property such as magnetism by which metallic objects can be sorted. For example, cardboard containers cannot be automatically sorted from plastic containers because no distinguishing physical property exists for either of those objects. Therefore, recycling non-magnetic objects depends in large part on hand sorting of the non-magnetic objects before disposal, or later at a recycling facility. Unfortunately, relying on individuals to sort non-magnetic objects is inefficient at best. Moreover, recycling non-magnetic objects is only valuable if the non-magnetic objects can be sorted by type. For example, cardboard containers cannot be recycled unless all other types of non-magnetic objects (e.g., plastics or glass) have been removed from the cardboard containers. It will be understood that the price per pound for non-magnetic objects is substantially lower than the price per pound for metallic objects, due in part to the cost of separating these objects by hand.

Therefore, a need exists for systems and/or methods for efficiently sorting non-magnetic objects that does not rely on hand sorting.

SUMMARY OF THE INVENTION

According to some embodiments, the present technology may be directed to systems for separating refuse. The systems may comprise: (a) a conveyor for translating refuse along a path, the refuse comprising non-magnetic objects and metallically augmented non-magnetic objects; and (b) a magnetic force generator extending along at least a portion of the conveyor and generating a magnetic force that causes the metallically augmented non-magnetic objects to remain in contact with the conveyor as the metallically augmented non-magnetic objects traverse along the path and as the non-magnetic objects are removed from conveyor.

According to other embodiments, the present technology may be directed to methods for sorting metallically augmented non-magnetic materials from non-magnetic refuse. These methods may comprise: (a) determining a magnitude of magnetic force required to attract a metallically augmented non-magnetic material to a conveyor, the magnitude of the magnetic force being based upon any of a percent weight amount of metallic material associated with the metallically augmented non-magnetic material, a weight of the metallically augmented non-magnetic material, or a distance between the conveyor and a magnetic force generator; (b) applying the determined magnitude of magnetic force to the metallically augmented non-magnetic material by the magnetic force generator to bring the metallically augmented non-magnetic material in contact with the conveyor; and (c) removing the non-magnetic refuse from the conveyor in such a way that the metallically augmented non-magnetic material remains in contact with the conveyor.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

DETAILED DESCRIPTION OF EXEMPLARY EMBODIMENTS

Figure 1:
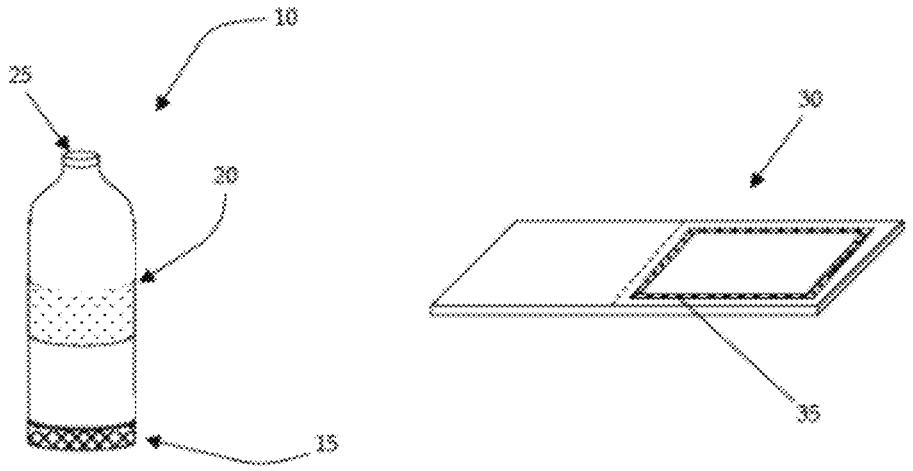
FIG. 1 includes perspective views of non-magnetic objects, each being augmented with a magnetic object.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

All materials are affected by magnetism to one degree or another. Furthermore, all materials may either be categorized as ferromagnetic, paramagnetic, and diamagnetic. Ferromagnetic materials such as iron, nickel, and cobalt become magnetic when exposed to a magnetic field. Ferromagnetic materials exhibit strong attraction to other magnetic materials and retain their magnetic properties when an external magnetic field is removed. Paramagnetic materials include magnesium, molybdenum, lithium, and tantalum, and are slightly attracted by a magnetic field. Paramagnetic materials do not retain their magnetic properties when an external magnetic field is removed. Diamagnetic materials include copper, aluminum, silver, and gold and are weakly repelled by external magnetic fields. It will be understood that most materials are diamagnetic.

Therefore, to more efficiently sort non-metallic and/or non-magnetic objects by type, each type of non-metallic and/or non-magnetic object may be provided with a predetermined amount of a magnetic material, such as metallic materials. For the purposes of brevity, the term "non-magnetic" will hereinafter be understood to include "non-metallic," "non-magnetic," or combinations of both types of materials. It is noteworthy that even though in a strict sense all objects are somewhat susceptible to magnetic forces, the term "non-magnetic" may be understood to include objects such as plastics, rubbers, glass, wood, paper, and/or other natural or synthetic materials that are negligibly susceptible (e.g., attracted) to magnetic forces. It will further be understood that the magnetic material includes at least one of a ferromagnetic, paramagnetic, or diamagnetic substance that allows the non-magnetic object to be sorted by one or more devices capable of creating at least one of a magnetic field and an eddy current. It will be understood that the metallic material may include a metallic adhesive, a metallic paint, a metallic object, or any combination thereof.

Referring now to the drawings, and more particularly to FIG. 1, shown therein are perspective views of non-magnetic objects augmented with a magnetic object.

For example, a plastic bottle 10 is shown as including having a predetermined amount of nickel shaped into the form of a band 15. The band can be wrapped around or fused to an outer surface of the plastic bottle 10. It will be understood that rather than wrapping the plastic bottle 10 with band 15, the nickel may be embedded or incorporated into a label 20 of the bottle 10 or associated with a cap 25.

In some instances, the magnetic material may comprise stainless steel in particulate form such as dust, granules, nanoparticles, beads, and/or other sizes of stainless steel that may be incorporated into a thermoplastic adhesive. Any type of thermoplastic adhesive may be utilized, but the exact composition of the adhesive may be selected based upon the adhesive's ability to bond with the material from which the recyclable product has been created. For example, a first type of adhesive may be selected for high density polyethylene (HDPE) and a second type of adhesive may be selected for polypropylene (PP).

The present technology may also be employed with other recyclable materials such as cardboard. For example, a collapsed cardboard box 30 may be augmented with a magnetic object 35 that includes a predetermined amount of magnesium. The magnetic object 35 may include a strip of magnesium secured to an outer surface of the cardboard box 30 by an adhesive. It will be understood that the magnetic object 35 may be disposed between the layers of the cardboard box 30. It will be understood that the amount of magnetic material included with the non-magnetic object may vary according to design requirements such as object weight. Additionally, the type of magnetic material chosen may include a ferromagnetic material, a diamagnetic material, a paramagnetic material, or any combinations thereof.

Furthermore, as the plastic bottle 10 having band 15 includes a ferromagnetic material and the cardboard box 30 includes a paramagnetic material, the objects each have different magnetic properties. More specifically, the plastic bottle 10 will attract more strongly to an external magnetic field than the cardboard box 30. This difference in magnetic properties allows for the objects to be selectively sorted from one another by exposing the objects to magnetic fields of differing magnitude.

According to other exemplary embodiments, various types of magnetic objects (not shown) may be created and applied to non-magnetic objects that allow the non-metallic objects to be sorted by one or more devices capable of creating at least one of a magnetic field and an eddy current. Exemplary metallic objects include magnetic adhesives and magnetic paints.

Generally speaking, a metallic (e.g., magnetic) augmented adhesive may be a combination of one or more adhesives and a predetermined amount of a metallic substance that is dispersed throughout the adhesive. As mentioned briefly above, it will be understood that the adhesive chosen should preferably bond well to the non-magnetic object with which it is associated. It will further be understood that the metallic substance combined with the adhesive may be at least one of a ferromagnetic, paramagnetic, diamagnetic material, or any combination of these. The metallic substance may be added to the adhesive in powder or liquid form or a combination of both.

Additionally, the metallic substance may be a mixture of two or more metallic substances. One of ordinary skill in the art will appreciate that the amount or type of metallic substance combined with the adhesive may be adjusted to alter the magnetic properties of the metallic adhesive. Methods for creating metallic adhesives are beyond the scope of this application but would be known to one of ordinary skill in the art having the present disclosure before them.

It will be understood that metallic adhesives may be utilized to fabricate objects such as liquid adhesive sprays, powder coatings, adhesive strips, and the like. For example, a metallic adhesive may be utilized by spraying, bonding, or otherwise contacting the metallic adhesive with a surface of a non-metallic object. For example, a plastic water bottle (also not shown) may have a predetermined amount of a metallic adhesive sprayed onto at least a portion of a bottom surface of the plastic water bottle. It will be understood that the metallic adhesive may be applied to the bottom surface of the plastic water bottle such that the metallic adhesive is inconspicuous. As such, the metallic adhesive spray may be clear or tinted with a colored pigment for various applications.

Generally speaking, choosing the type or amount of metallic adhesive for a particular non-magnetic object depends, in part, on one or more physical characteristics of the non-magnetic object, such as weight, geometrical configuration, and the like. For example, plastic water bottles may require less metallic adhesive than a glass bottle because the plastic water bottle weighs less than the average glass bottle.

It will be understood that the metallic adhesive may be applied to the non-magnetic object in layers to increase the magnetic property of the non-magnetic object.

In accordance with other embodiments, a metallic material may include a metallic paint that can be applied to a non-magnetic object such as a glass bottle, or alternatively, a diamagnetic object such as an aluminum can. It will be understood that because aluminum cans are diamagnetic, an aluminum can may only be separated from other refuse by hand or with an eddy current generator. To simplify sorting aluminum cans, an aluminum can may include a predetermined amount of metallic paint that is sprayed onto the aluminum can during the manufacturing process. The aluminum can may also include a predetermined amount of metallic adhesive depending upon design requirements.

Figure 2:
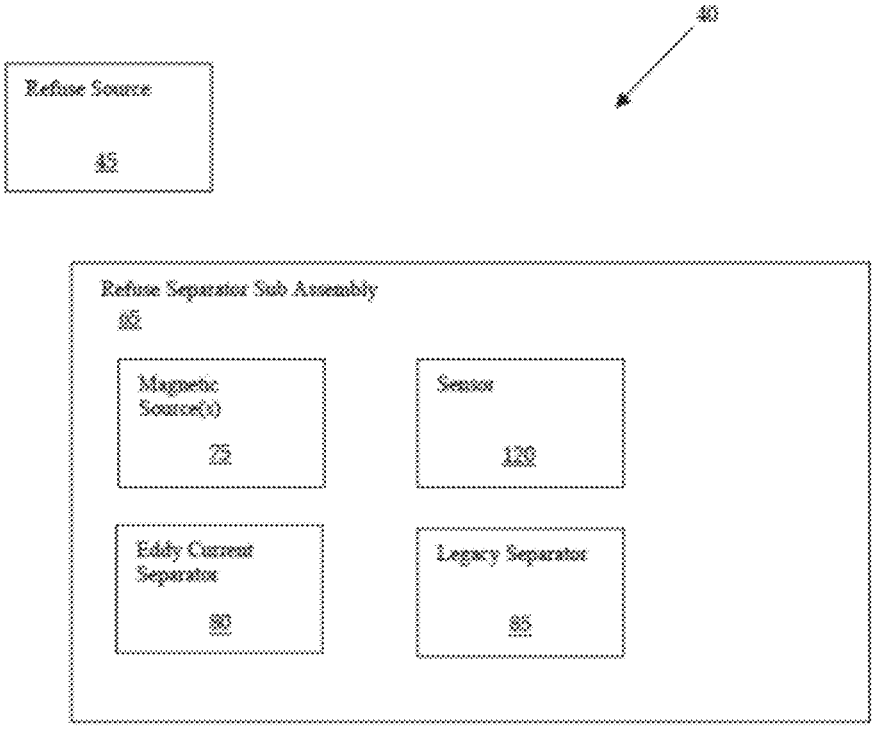
FIG. 2 is a block diagram of an exemplary environment for practicing embodiments of the present technology.

In greater detail, FIG. 2 illustrates an exemplary system 40 for practicing embodiments of the present invention. In general, the system 40 includes a refuse source 45 providing refuse that includes metallic and non-magnetic objects, wherein at least a portion of the non-magnetic objects have been augmented with a magnetic object or magnetic material. The system 40 also includes a refuse separator sub assembly 65 that includes a refuse communicator 70, at least one magnetic source 75, at least one eddy current generator 80, and a legacy separator 85.

In one embodiment, the refuse communicator 70 includes a continuous conveyor belt 90 receiving refuse from the refuse source 45. It will be understood that the refuse communicator 70 may include any number of devices adapted to communicate refuse along one or more paths. It will be further understood that the magnetic source 75 and the eddy current generator 80 may be combined into one device.

Figure 3:
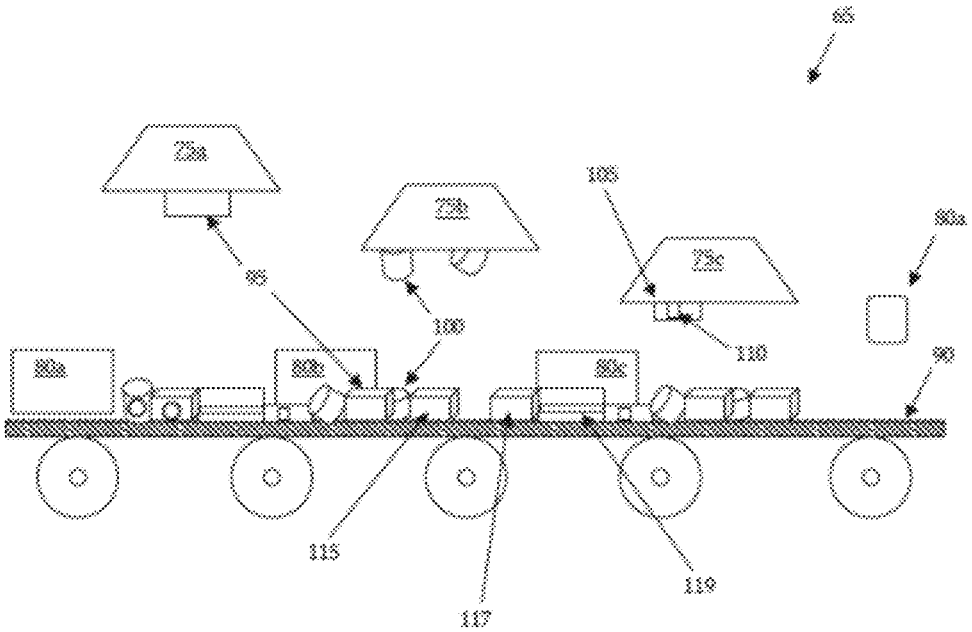
FIG. 3 is a side elevation view of a magnetic separator sub-assembly.
Figure 4:
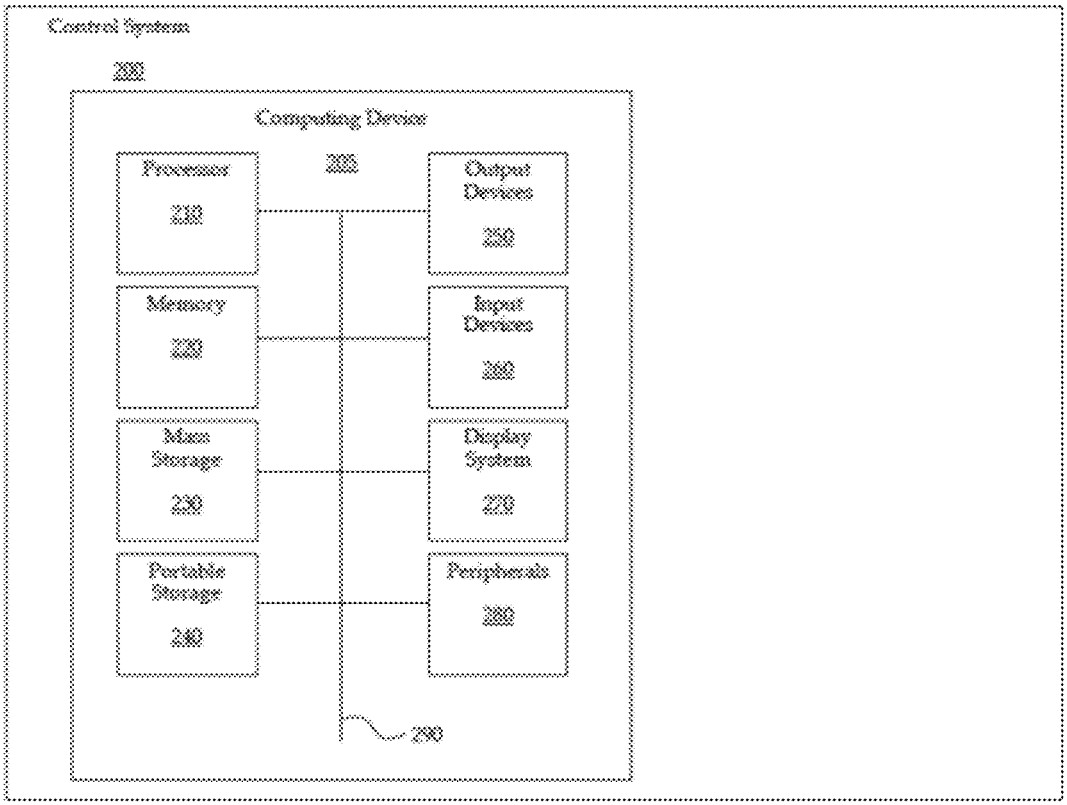
FIG. 4 illustrates an exemplary computing system that may be used to implement an embodiment of the present technology.

Referring now to FIG. 3, the refuse separator sub assembly 65 includes a plurality of magnetic sources 75*a-c* that are capable of creating magnetic fields to attract both ferromagnetic and paramagnetic objects. Also, the magnetic sources 75*a-c* may be electromagnets wherein the magnetic field generated by the magnetic sources 75*a-c* can be selectively controlled via application of an electrical current thereto, the control of which is dictated by a control system 200 (FIG. 4). The magnetic sources 75*a-c* are disposed directly above the conveyor belt 90 at varying heights. It will be understood that because each of the magnetic sources is disposed at a different height than the other adjacent magnetic sources, the magnetic sources 75*a-c* are capable of exerting varying magnitudes of magnetic fields on the refuse communicating along the conveyor belt 90. More specifically, the magnetic sources 75*a-c* are arranged in order of increasing magnitude, wherein magnetic source 75*a* creates a magnetic field that is weaker than magnetic source 75*b*, and likewise with magnetic source 75*c*.

It will be understood that the height of the magnetic sources 75*a-c* may be selectively adjustable. It will further be understood that the refuse separator sub assembly 65 may include more or fewer magnetic sources depending upon design requirements.

Additionally, the refuse separator sub assembly 65 may include a plurality (optionally one or more) of eddy current generators 80*a-c* disposed along the length of the conveyor belt 90 to repel objects with diamagnetic properties. Similarly to the magnetic sources 75*a-c*, the eddy current generators 80*a-c* are disposed in order of increasing magnitude, wherein eddy current generator 80*a* creates an eddy current that is weaker than eddy current generator 80*b*, and likewise with eddy current generator 80*c*.

In operation, to separate refuse according to metallic (e.g., magnetic) content, the refuse is communicated underneath magnetic sources 75*a-c* and by eddy current generators 80*a-c*. Metallic objects 95 that include solid ferromagnetic objects such as iron scrap are attracted to magnetic source 75*a*. Metallic objects 100 that include solid paramagnetic objects such as copper wiring are attracted to the magnetic field generated by magnetic source 75*b* but not to the weaker magnetic field generated by magnetic source 75*a*. Non-magnetic objects 105 include plastic bottles having a predetermined amount of spray adhesive 110. The predetermined amount of spray adhesive 110 may include a ferromagnetic or paramagnetic metallic adhesive that is attracted to magnetic source 75*c* but not to the weaker magnetic fields generated by magnetic sources 75*a* and 75*b*.

As is apparent, any number of magnetic sources capable of exerting various magnetic forces may be utilized along the conveyor belt 90 to separate any number of types of non-magnetic objects based upon the magnetic properties of the predetermined amount of a metallic object associated therewith. Therefore, all plastic objects may include a predetermined amount of a metallic material that attracts the plastics to a magnetic source generating a first magnetic field. Other non-magnetic objects containing a differing amount of a metallic material may be similarly attracted to other magnetic sources.

Rather than attracting non-magnetic objects by magnetic sources, non-magnetic objects having a metallic material that includes one or more diamagnetic materials may be ejected from conveyor belt 90 by eddy current generators 80*a-c*. Non-magnetic objects 115 such as solid aluminum may be pushed off the conveyor belt 90 by eddy current generator 80*a*. Non-magnetic objects 117 such as a glass bottle having a label that includes a metallic paint having a predetermined amount of magnesium may be pushed off conveyor belt 90 by eddy current generator 80*b*, but not by the weaker eddy current generated by eddy current generator 80*a*. Additionally, non-magnetic objects 119 such as cardboard containers having an aluminum strip embedded therein may be pushed off conveyor belt 90 by eddy current generator 80*b* but not be the weaker eddy current generated by eddy current generator 80*a* and 80*b*.

It will further be understood that refuse separator sub assembly 65 may include any number of magnetic sources or eddy current generators as required to separate metallic and non-magnetic objects with varying degrees of specificity based upon the susceptibility of those objects to magnetic fields and eddy currents.

For example, it may be desirable to separate plastic objects based upon the type of plastic. In particular, containers made from PETE (polyethylene terephthalate) may include a first amount of aluminum, HDPE (high-density polyethylene) containers may include a second amount of aluminum, and ABS (acrylonitrile butadiene styrene) objects may include yet a third amount of aluminum. Each of the objects will then be repelled by different eddy current generators positioned along the conveyor belt based upon the magnitude of the magnetic fields created by the eddy current generators.

As the conveyor belt 90 is a continuous mechanism, objects that were not separated may be re-circulated through the refuse separator sub assembly 65. Alternatively, system 40 also includes a legacy separator system 85 for separating objects. Legacy system 85 may include any type of separator system such as hand sorting. One will appreciate that because the refuse separator sub assembly 65 separates the vast majority of the refuse, the refuse communicated to the legacy system 85 may be separated with greater efficiency.

Rather than utilizing the legacy separator 85, the system 40 may include one or more sensors 120 such as a metal detector positioned along the conveyor belt 90 after the magnetic sources and eddy current generators. The sensors 120 are capable of sensing ferromagnetic, paramagnetic, and/or diamagnetic objects and generating output indicative of the objects. The output of sensors 120 may be communicated to a control system 200 that includes a computing system 205 (FIG. 4) having one or more evaluation modules adapted to evaluate the output of the sensors 120. When the sensors 120 sense objects having magnetic properties, the objects are re-circulated through the refuse separator sub assembly 65 for further processing.

Referring now to FIG. 4 that illustrates an exemplary computing system 205 that may be used to implement an embodiment of the present technology. The components shown in FIG. 4 are depicted as being connected via a single bus. The components may be connected through one or more data transport means. Processor unit 210 and main memory 220 may be connected via a local microprocessor bus, and the mass storage device 230, peripheral device(s) 280, portable storage device 240, and display system 270 may be connected via one or more input/output (I/O) buses.

Mass storage device 230, which may be implemented with a magnetic disk drive or an optical disk drive, is a non-volatile storage device for storing data and instructions for use by processor unit 210. Mass storage device 230 can store the system software for implementing embodiments of the present invention for purposes of loading that software into main memory 220.

Portable storage device 240 operates in conjunction with a portable non-volatile storage medium, such as a floppy disk, compact disk, digital video disc, or USB storage device, to input and output data and code to and from the computer system 200 of FIG. 4. The system software for implementing embodiments of the present invention may be stored on such a portable medium and input to the computer system 205 via the portable storage device 240.

Input devices 260 provide a portion of a user interface. Input devices 260 may include an alpha-numeric keypad, such as a keyboard, for inputting alpha-numeric and other information, or a pointing device, such as a mouse, a trackball, stylus, or cursor direction keys. Additionally, the system 205 as shown in FIG. 4 includes output devices 250. Suitable output devices include speakers, printers, network interfaces, and monitors.

Display system 270 may include a liquid crystal display (LCD) or other suitable display device. Display system 270 receives textual and graphical information, and processes the information for output to the display device.

Peripherals 280 may include any type of computer support device to add additional functionality to the computer system. Peripheral device(s) 280 may include a modem or a router.

The components contained in the computer system 205 of FIG. 4 are those typically found in computer systems that may be suitable for use with embodiments of the present invention and are intended to represent a broad category of such computer components that are well known in the art. Thus, the computer system 205 of FIG. 4 can be a personal computer, hand held computing device, telephone, mobile computing device, workstation, server, minicomputer, mainframe computer, or any other computing device. The computer can also include different bus configurations, networked platforms, multi-processor platforms, etc. Various operating systems can be used including Unix, Linux, Windows, Macintosh OS, Palm OS, Android, iPhone OS and other suitable operating systems.

It is noteworthy that any hardware platform suitable for performing the processing described herein is suitable for use with the technology. Computer-readable storage media refer to any medium or media that participate in providing instructions to a central processing unit (CPU), a processor, a microcontroller, or the like. Such media can take forms including, but not limited to, non-volatile and volatile media such as optical or magnetic disks and dynamic memory, respectively. Common forms of computer-readable storage media include a floppy disk, a flexible disk, a hard disk, magnetic tape, any other magnetic storage medium, a CD-ROM disk, digital video disk (DVD), any other optical storage medium, RAM, PROM, EPROM, a FLASH EPROM, any other memory chip or cartridge.

Figure 5:
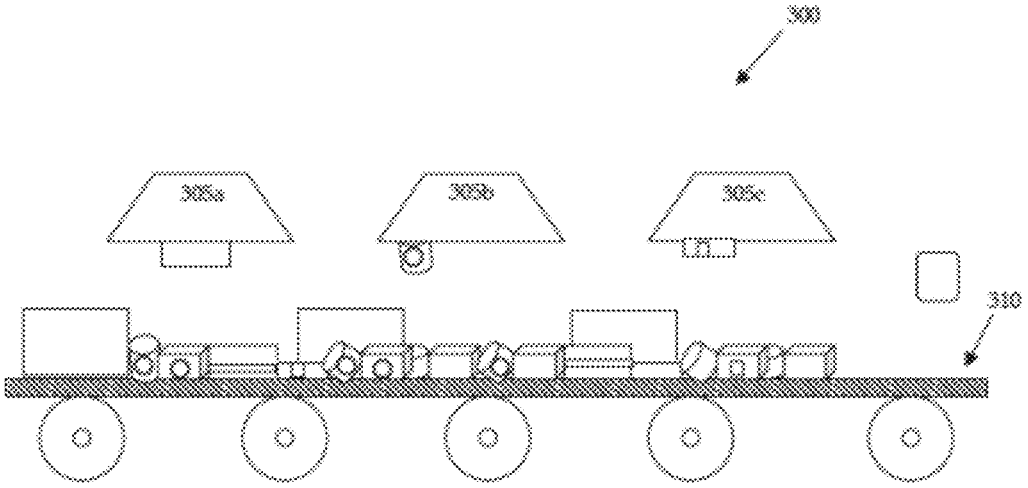
FIG. 5 is a side elevation view of an alternate magnetic separator sub-assembly.

Referring now to FIG. 5, an alternative refuse separator sub assembly 300 is shown wherein magnetic sources 305*a-c* have been positioned above the conveyor belt 310 similarly to the refuse separator sub assembly 65 (FIG. 3). In this embodiment, it will be understood that the magnetic sources 305*a-c* are preferably selectively adjustable such that the magnetic fields generated by the magnetic sources 305*a-c* can be arranged in order of magnitude similarly to the refuse separator sub assembly 65, although the magnitude of the magnets may be selectively adjusted based upon design requirements.

Although not shown, in an additional embodiment, the refuse separator sub assembly may include only one selectively adjustable magnetic source. Refuse may be re-circulated through the refuse separator sub assembly as many times as necessary to separate the refuse. After each pass of the refuse through the refuse separator sub assembly, the magnitude of the magnetic source can be adjusted to produce a magnetic field that is different in magnitude from a previous pass.

Figure 6:
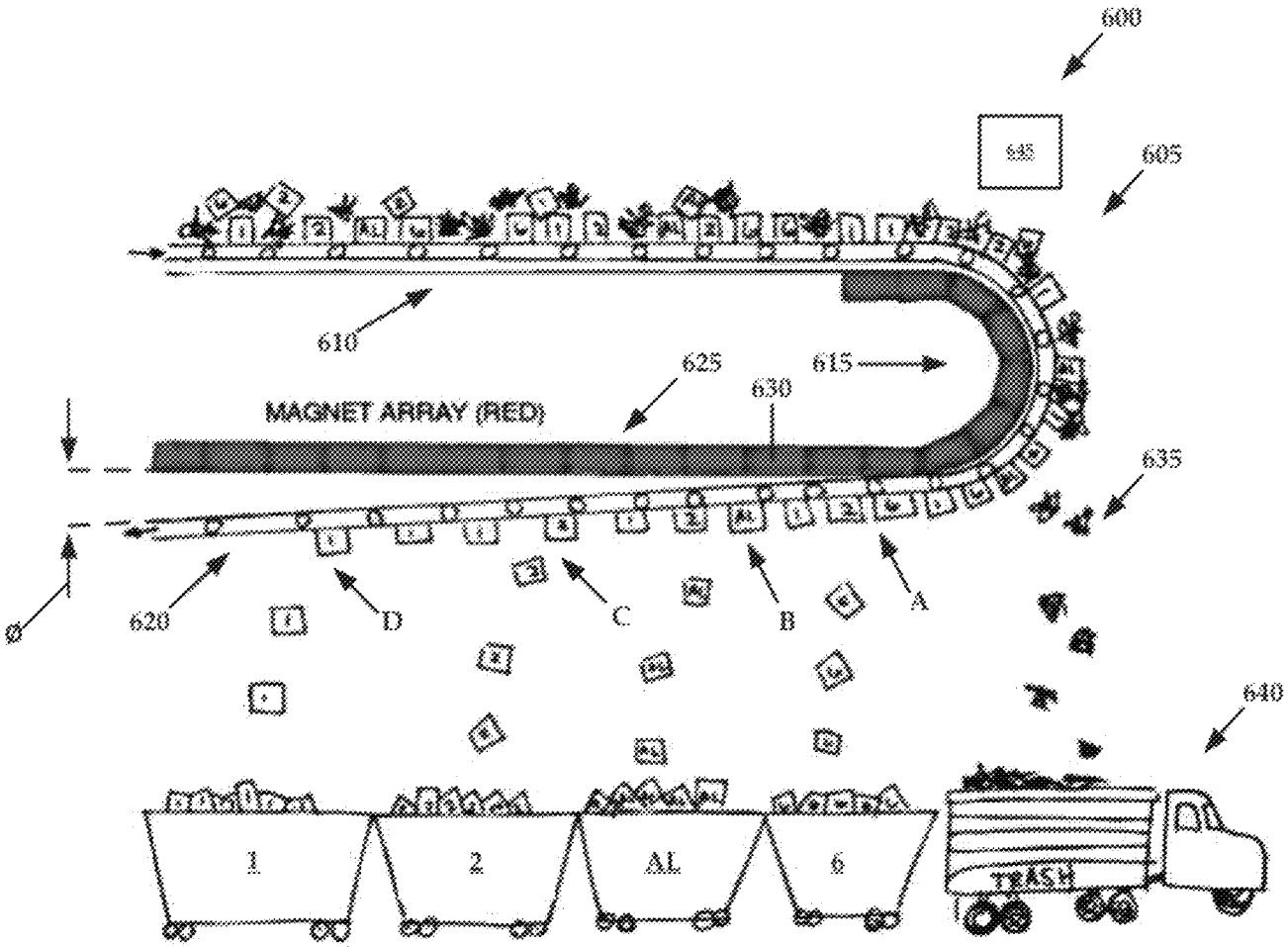
FIG. 6 is a perspective view of a recycling system, constructed in accordance with the present disclosure.

FIG. 6 illustrates an exemplary recycling system 600 for practicing aspects of the present technology. In general, the recycling system 600 includes conveyor assembly 605 for conveying refuse that includes metallic and non-magnetic objects, wherein at least a portion of the non-magnetic objects have been augmented with a metallic object or metallic material(s). The conveyor assembly 605 may be arranged to include a substantially linear upper portion 610, followed by a substantially arcuate portion 615, which transitions into a substantially linear lower portion 620.

A magnetic array 625 may be disposed inside (e.g. within) of the conveyor assembly 605. In some instances, the magnetic array 625 may begin towards the end of the substantially linear upper portion 610 of the conveyor assembly 605 and extend around the substantially arcuate portion 615 and along at least a portion of the substantially linear lower portion 620 of the conveyor assembly 605. The substantially linear lower portion 620 of the conveyor assembly 605 may be spaced apart and angled away from the magnetic array 625 at a given diverging angle Ø. The spacing of the substantially linear lower portion 620 of the conveyor assembly 605 and the magnetic array 625 may increase due to the diverging angle Ø between the substantially linear lower portion 620 of the conveyor assembly 605 and the magnetic array 625. The increasing spatial differential between substantially linear lower portion 620 of the conveyor assembly 605 and the magnetic array 625 may affect the magnetic force exerted on the magnetic objects that are carried along the conveyor assembly 605, as will be discussed in greater detail below.

The magnetic array 625 may comprise a single and continuous magnetic force generator, or may, in some instances, comprise a plurality of individual magnetic force generators 630 that are placed end-to-end to form the magnetic array 625. The magnetic force generators 630 may generate either a continuous or variable amount of magnetic force.

As refuse is carried along the conveyor assembly 605, magnetic forces are exerted on the metallic, non-metallic, and metallically augmented non-magnetic products by the magnetic array 625, when the refuse reaches the end of the substantially linear upper portion 610 of the conveyor assembly 605. The magnetic forces exerted by the magnetic array 625 may be of sufficient magnitude to ensure that all (or a substantial portion) metallic and metallically augmented non-magnetic products adhere to the conveyor assembly 605 as the refuse is drawn around the substantially arcuate portion 615 of the conveyor assembly 605. It is noteworthy that in embodiments when the magnetic array 625 is disposed below (e.g., inside) of the conveyor assembly 605, as opposed to above the conveyor assembly 605 (such as in some of the embodiments described above), the magnetic force that is exerted by the magnetic array 625 may be substantially constant in magnitude. Moreover, the magnitude of the magnetic force that is exerted by the magnetic array 625 may be lower because the magnetic array 625 is only required to exert magnetic forces upon the magnetic objects across a shorter distance (e.g., the distance between the magnetic array 625 and the outer surface of the conveyor assembly 605).

Non-metallic and/or non-magnetic refuse (shown as refuse 635) that has not been metallically augmented, such as paper, rubber, wood, and so forth may fall off the conveyor assembly 605 and into a containment vehicle 640 or bin, as the refuse 635 travels around the substantially arcuate portion 615 of the conveyor assembly 605.

As previously mentioned, different non-magnetic objects may be associated with different amounts of magnetic augmentation relative to one another. Additionally, because the magnetic array 625 and the conveyor assembly 605 may be incrementally spaced apart from one another at the divergent angle Ø, differently metallically augmented objects may remain in contact with the conveyor assembly 605 for a longer period of time. As the space between the magnetic array 625 and the conveyor assembly 605 increases, the magnetic forces exerted on the refuse traveling along the path of the conveyor decreases. Therefore, metallically augmented refuse that is weakly magnetic may remain in contact with the conveyor assembly only until dropdown point A. Other metallically augmented refuse that is more strongly magnetic may remain in contact with the conveyor assembly until it reaches dropdown point B, while other metallically augmented refuse that is even more strongly magnetic may remain in contact with the conveyor assembly until it reaches dropdown point C. Metallically augmented refuse that is the most magnetic may remain in contact with the conveyor assembly until it reaches dropdown point D. Positioned below each of the dropdown points A, B, C, and D, is a recycling bin, such as bins 6, AL, 2, and 1, respectively.

Prior to operation of the recycling system 600, a plurality of different types of non-magnetic products may be each be magnetically "coded" with a predetermined amount of magnetic material, as described in greater detail above. As each specific type of recyclable material (polycarbonate, polyethylene, cardboard, polystyrene, aluminum, etc.) needs to be separated from the refuse stream as well as from the other different recyclable materials, each type non-magnetic object may be "coded" separately with a different magnetic percent-weight (% wt). In this way, different objects subjected to a magnetic inverted conveyor-belt system (such as recycling system 600) can be separated by varying the magnetic force across a specified distance (the variable distance between substantially linear lower portion of the conveyor assembly 605 and the magnet array 625). When the force applied by the magnetic array 625 becomes less than the weight of the object, the magnetic force exerted by the magnetic array is no longer able to keep the object in contact with the conveyor assembly 605.

As background, magnetic force that a magnetic object is susceptible to is directly proportional to a magnetic object's mass. A percent ratio of magnetic material to non-magnetic material (% wt) allows the force on a metallically augmented non-magnetic object to be varied and, as such, intentionally designed for a specific extraction mechanism, such as the recycling system 600. Also, the magnetic force on an object from an electromagnet decreases exponentially with respect to distance from the magnet surface, and more specifically, it decreases with the square of the distance from the magnetic force generator. Using these known principles, suitable amounts of magnetic material may be selected for a given object having a particular weight. Additionally, the angle Ø of the space between the conveyor assembly 605 and the magnetic array 625 may be established and/or selected.

By way of non-limiting example, a type of polystyrene (PS) container may be provided with a percent weight (% wt) of magnetic material of five. Aluminum (AL) cans may be provided with a percent weight (% wt) of magnetic material of eight. A type of high density polyethylene (HDPE) bottle may be provided with a percent weight (% wt) of magnetic material of nine, while a type of polyethylene terephthalate (PETE) container may be provided with a percent weight (% wt) of magnetic material of nine.

In operation, as the refuse containing the above-described metallically augmented objects is moved along the conveyor assembly 605, the magnetic force exerted on the PS containers is overcome by the mass of the PS containers at point A, allowing the PS containers to drop down into bin 6. Magnetic force exerted on the AL cans is overcome by the mass of the AL cans at point B, allowing the AL cans to drop down into bin AL. Magnetic force exerted on the HDPE bottles is overcome by the mass of the HDPE bottles at point C, allowing the HDPE bottles to drop down into bin 2. Likewise, magnetic force exerted on the PETE containers is overcome by the mass of the PETE containers at point D, allowing the PETE containers to drop down into bin 1. The above-described example may also comprise additional or fewer drop down points depending on both configuration of the metallically augmented objects (the % wt of magnetic material for a product) as well as the angle Ø between the conveyor assembly 605 and the magnet array 625.

According to some embodiments, the system 600 may comprise a pneumatic source 645 that may direct forced air across the conveyor assembly 605 to remove non-magnetic refuse from the metallically augmented non-magnetic objects that are in contact with the conveyor assembly 605.

Figure 7A:
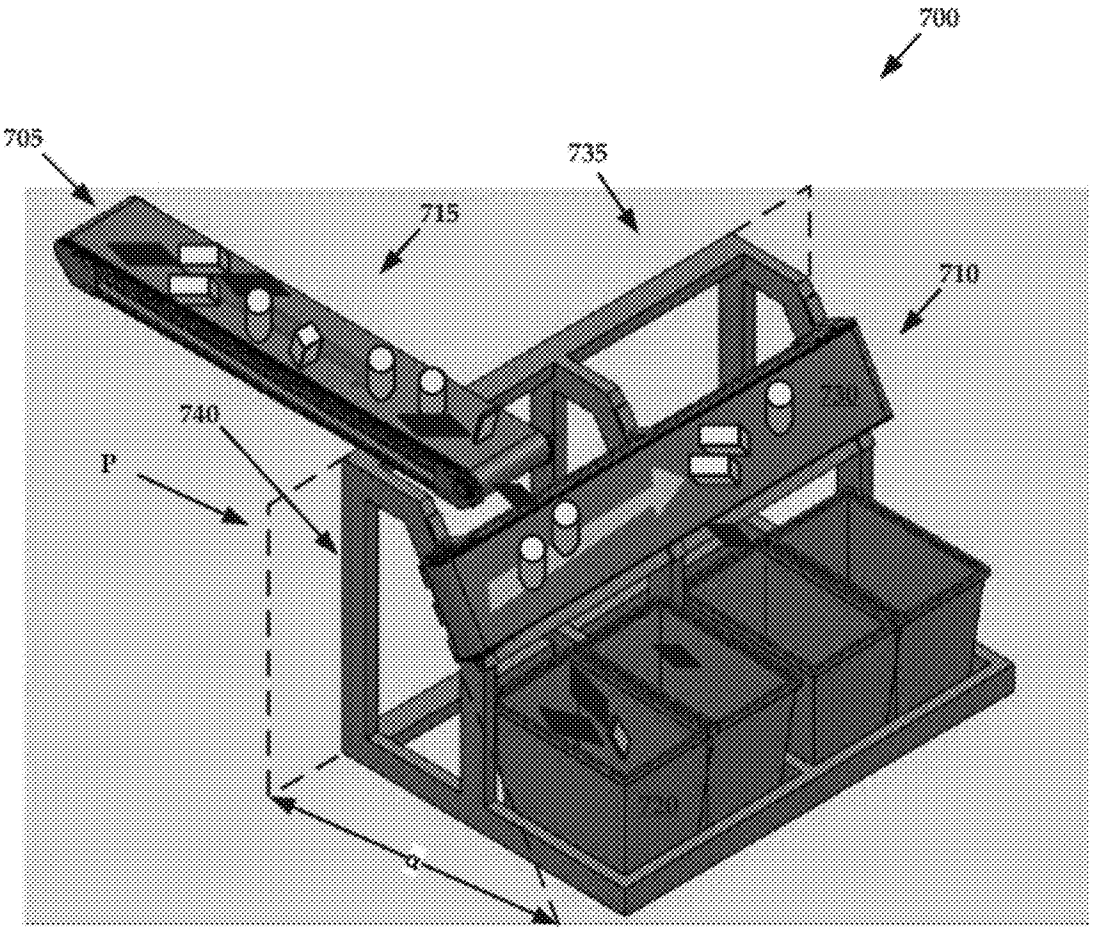
FIG. 7A is a perspective view of an exemplary embodiment of another recycling system, constructed in accordance with the present disclosure.
Figure 7B:
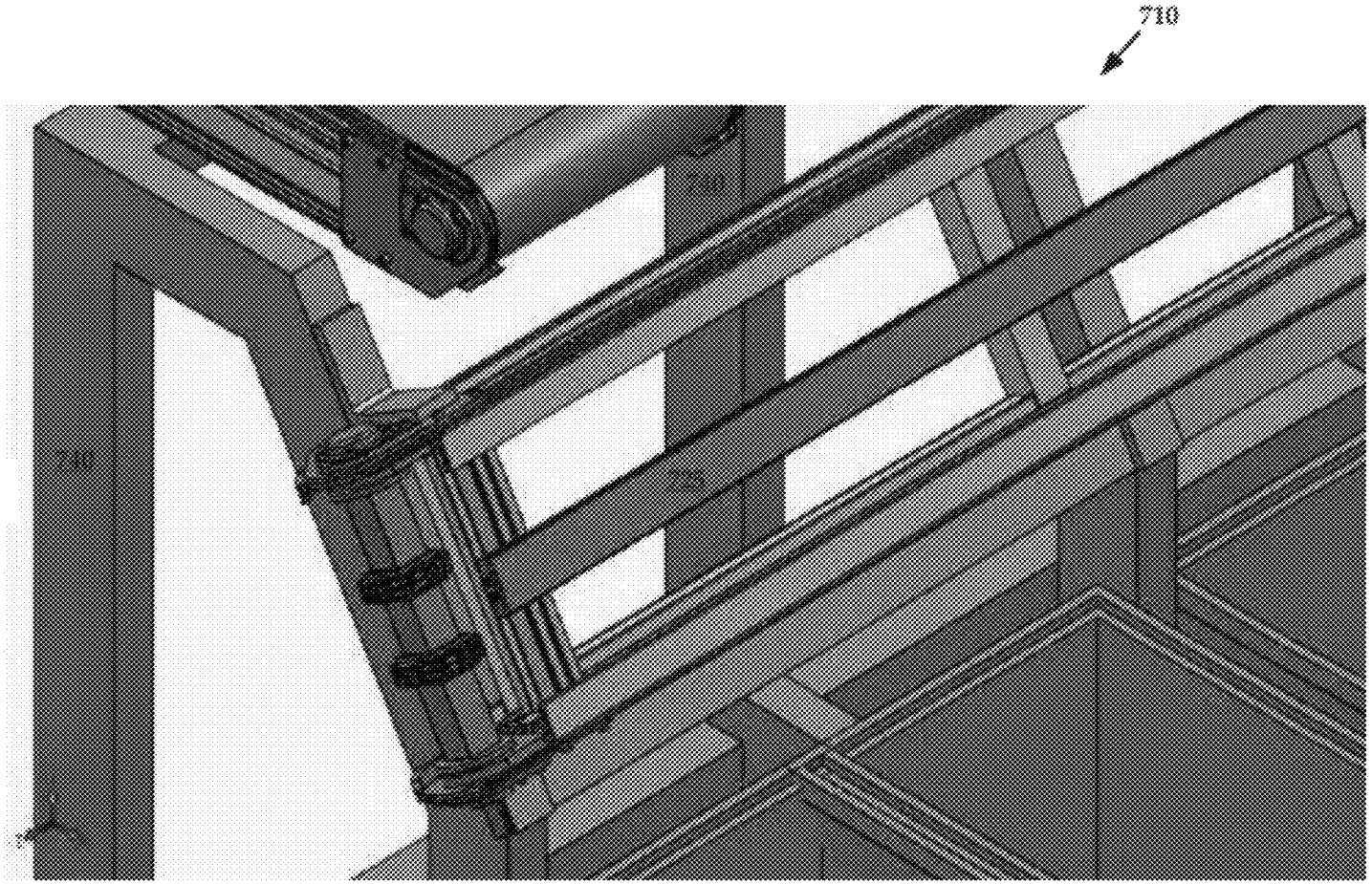
FIG. 7B is a partial perspective view of a conveyor and a magnetic force generator of the recycling system of FIG. 7A.

Referring now to FIGS. 7A-B collectively, which illustrate an exemplary recycling system 700. The system 700 may comprise a first conveyor 705 and at least one additional conveyor, such as a second conveyor 710. Refuse 715, including magnetic, non-magnetic, and/or metallically augmented non-magnetic material, may be directed towards the second conveyor 710 by the first conveyor 705. According to some embodiments, the first conveyor 705 may not be associated with a magnetic force generator. Therefore, all refuse 715 may fall off the end of the first conveyor 705. Non-magnetic objects (e.g., glass bottles, paper cups, thin plastic packaging, etc.) that have not been augmented with a metallic material may fall directly into a bin 720 disposed below the first conveyor.

FIG. 7B is a partial perspective view of the second conveyor 710. Magnetic objects and non-magnetic objects that have been augmented with magnetic materials may be attracted to the second conveyor 710 by a magnetic force generator 725 that extends along at least a portion of the length of the second conveyor 710. According to some embodiments, the magnetic force generator 725 may comprise a magnetic rod having a given length. In other embodiments, the magnetic force generator 725 may comprise an array of magnetic force generators such as the magnetic array 625 of FIG. 6. One of ordinary skill in the art will appreciate that many types and/or arrangements of magnetic force generators or other objects which may be utilized to magnetically attract magnetic objects may also likewise be utilized in accordance with the present technology.

It is noteworthy that the magnetic force generator 725 may be disposed below a belt 730 of the second conveyor 710. In some embodiments the magnetic force generator 725 may be spaced apart from the belt 730 of the second conveyor 710 at a substantially equal distance along the length of the second conveyor 710. In other embodiments the space between the magnetic force generator 725 and the belt 730 may vary along the length of the second conveyor 710.

According to some embodiments, the second conveyor 710 may be disposed substantially perpendicular to the first conveyor 705. Additionally, the second conveyor 710 may be attached to a frame 735 in such a way that the second conveyor 710 is disposed at an angle $\alpha$ relative to a reference plane P extending through back struts 740 of the frame 735. The angle $\alpha$ of the second conveyor 710 may vary according to design requirements such as the speed of the first and second conveyors, the magnetic force that is exerted by the magnetic force generator 725, and/or the angle of the first conveyor 705.

If commonly recyclable plastic objects such as bottles or containers are augmented with a magnetic material, the metallically augmented plastic objects may be reclaimed by using a single magnetic conveyor.

It will be understood that while the system 700 has been described as comprising a second conveyor 710, the system 700 may comprise additional conveyors that are arranged in a tiered manner. Each of the additional conveyors may be attached to the frame 735 in the same manner as the second conveyor 710 such that they are disposed at an angle. The additional conveyors may be arranged along the same angle $\alpha$ or may be offset from one another.

Additionally, each additional conveyor may comprise a magnetic force generator that produces a different magnetic force relative to one another. The system 700 may be arranged such that the conveyor at the top (which may be second conveyor 710) may exert the least amount of magnetic force to attract magnetic objects that are highly magnetic relative to the other types of magnetic objects that are processed by the system 700. Each successively lower conveyor may exert more magnetic force that the conveyor disposed above to capture different types of magnetic objects that have lower magnetic attraction that those magnetic objects captured by the conveyor that is disposed immediately above. As such, magnetic objects with differing magnetic attraction (e.g., magnetic coding as described above) levels relative to one another may be attracted to different conveyors. Each conveyor may lead to a different recycling bin, allowing similarly coded (e.g., augmented) objects to be sorted and grouped together.

Figure 8:
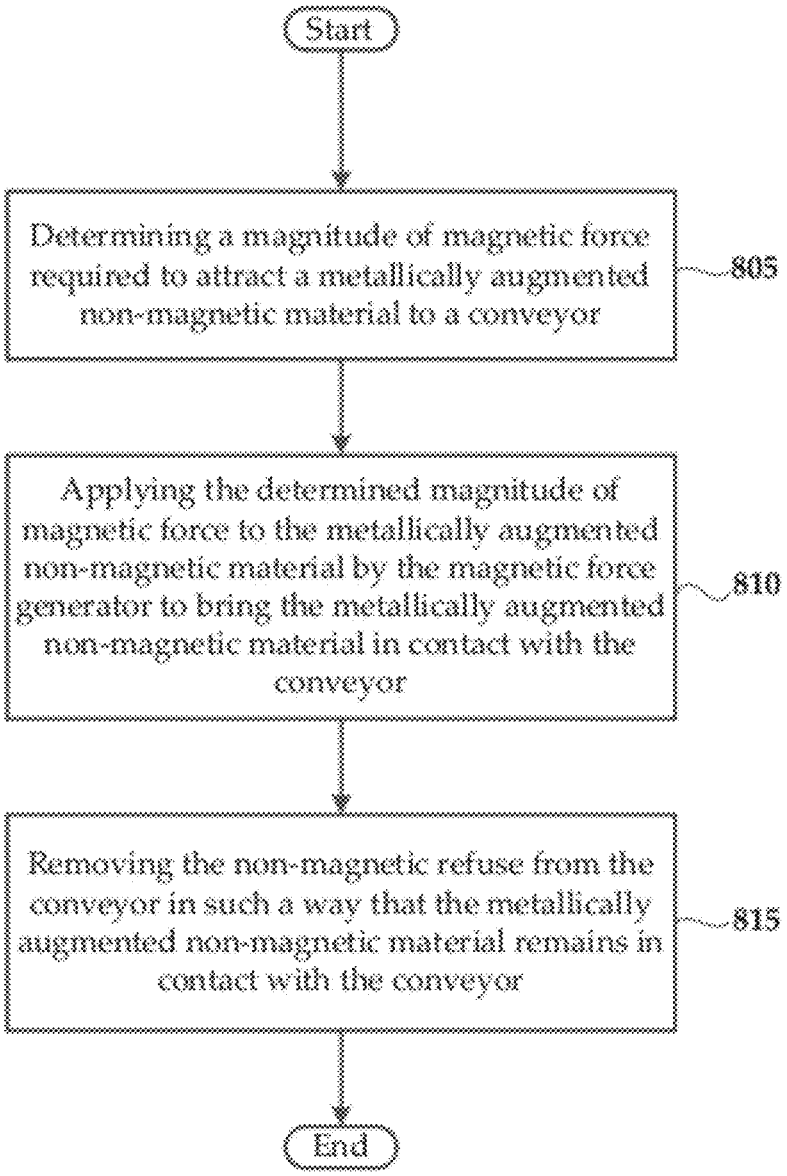
FIG. 8 is a flowchart of an exemplary method of sorting metallically augmented non-magnetic materials from non-magnetic refuse.

FIG. 8 illustrates a flowchart of an exemplary method for sorting metallically augmented non-magnetic materials from non-magnetic refuse. The method may comprise a step 805 of determining a magnitude of magnetic force required to attract a metallically augmented non-magnetic material to a conveyor. It will be understood that the magnitude of the magnetic force may be based upon any of a percent weight amount of metallic material associated with the metallically augmented non-magnetic material, a weight of the metallically augmented non-magnetic material, and/or a distance between the conveyor and a magnetic force generator.

Once the magnitude of the magnetic force has been determined, the method may comprise a step 810 of applying the determined magnitude of magnetic force to the metallically augmented non-magnetic material by the magnetic force generator to bring the metallically augmented non-magnetic material in contact with the conveyor. Finally, the method may comprise a step 815 of removing the non-magnetic refuse from the conveyor in such a way that the metallically augmented non-magnetic material remains in contact with the conveyor. As mentioned above, non-magnetic refuse may be removed from the conveyor by use of force air or by way of gravity, for example, by translating the non-magnetic refuse off of an end of the conveyor.

In the foregoing specification, specific embodiments of the present disclosure have been described. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Figure 9A:
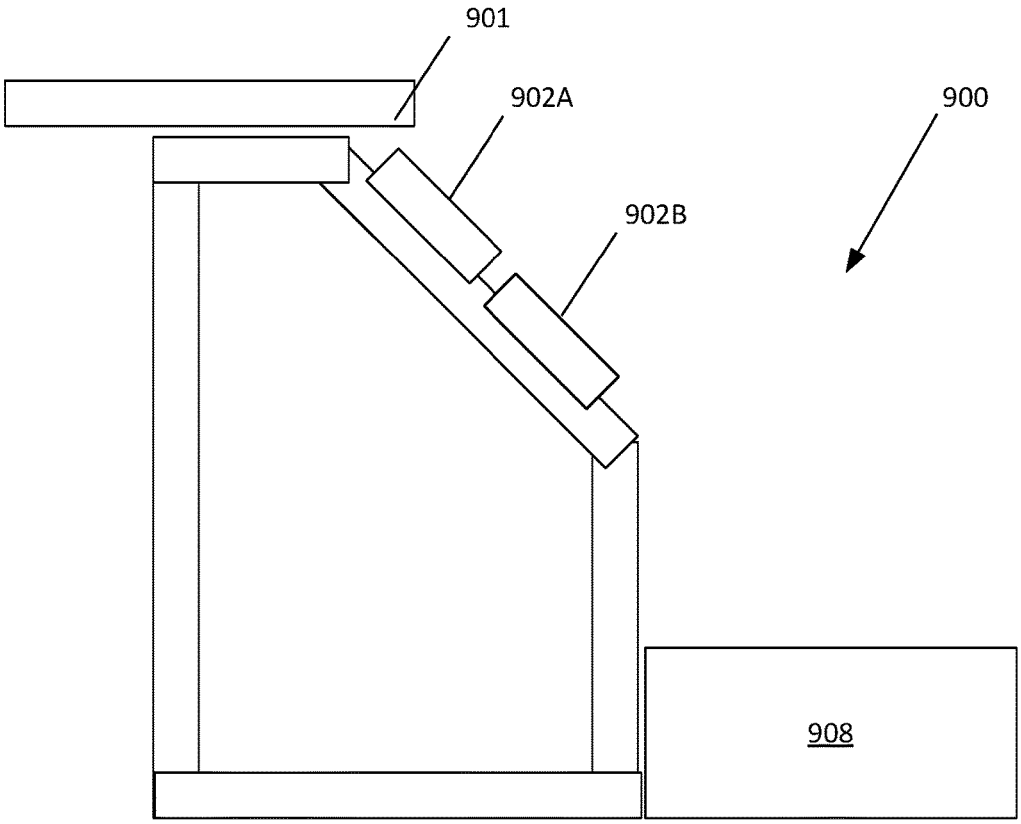
FIGS. 9A and 9B collectively illustrate another embodiment of a system that includes a plurality of conveyors.
Figure 9B:
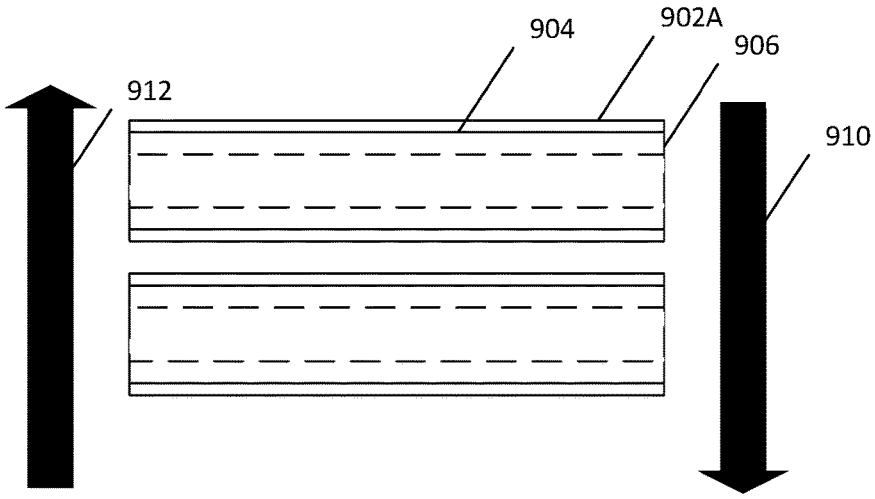

FIGS. 9A and 9B illustrate a system 900 for separating refuse, the system comprising a plurality of conveyors 902A-B. A first conveyor 901 is illustrated as with the embodiments of FIGS. 7A and 7B. Indeed, the system 900 of FIGS. 9A and 9B is similar to the system of FIGS. 7A and 7B, as mentioned above. Each of the plurality of conveyors, such as conveyor 902A having a conveyor belt 904 and a magnetic force generator 906 extending along at least a portion of the conveyor belt 904 and generating a magnetic force that causes the metallically augmented non-magnetic objects to remain in contact with the respective conveyor as the metallically augmented non-magnetic objects traverse along the path and as the non-magnetic objects are removed from the respective conveyor belts.

In one embodiment, the plurality of conveyors 902A-B are arranged in a tiered manner. Each of the plurality of conveyors comprises a first end, a second, end, an upper side and a lower side, further wherein the each of plurality of conveyors are disposed at an angle so as to allow non-magnetic objects to fall off the lower side of the conveyor belt (e.g., towards bin 908). In some embodiments, the plurality of conveyors 902A-B are offset from one another. Each of the plurality of conveyors 902A-B produces a different magnetic force relative to one another. For example, an uppermost conveyor 902A exerts a least amount of magnetic force. Each successively lower conveyor exerts a higher magnetic force than a conveyor position above as illustrated by the arrow 910 of increasing magnetic force. In another embodiment, an uppermost conveyor 902A of the plurality of conveyors exerts a least amount of magnetic force. Each successively lower conveyor exerts a higher magnetic force than that above it as illustrated by arrow 912 of decreasing magnetic force.

What is claimed is:

1. A system for separating refuse, the system comprising:

a frame comprising:

a plurality of back struts defining a reference plane;

a frame tie that joins the plurality of back struts to one another;

inclined frame supports that extend from the plurality of back struts;

a first conveyor for translating refuse, the refuse comprising non-magnetic objects and metallically augmented non-magnetic objects, wherein the metallically augmented non-magnetic objects comprise a first portion with a first level of magnetism and a second portion with a second level of magnetism that is less than the first level of magnetism;

a second conveyor for receiving the refuse from the first conveyor, wherein the second conveyor is mounted to the inclined frame supports;

an additional conveyor for receiving the refuse from the second conveyor, wherein the additional conveyor is mounted to the inclined frame supports, wherein the additional conveyor and the second conveyor are configured in a tiered relationship with one another;

a magnetic force generator extending along at least a portion of the second conveyor and generating a magnetic force that causes the metallically augmented non-magnetic objects having the first level of magnetism to remain in contact with the second conveyor as the metallically augmented non-magnetic objects having the first level of magnetism traverse along the second conveyor and as the metallically augmented non-magnetic objects having the second level of magnetism and the non-magnetic objects slide off the second conveyor in a direction that is perpendicular to a direction of travel of the metallically augmented non-magnetic objects having the first level of magnetism as the metallically augmented non-magnetic objects having the first level of magnetism remain in contact with the second conveyor;

another magnetic force generator extending along at least a portion of the additional conveyor and generating a magnetic force that causes the metallically augmented non-magnetic objects having the second level of magnetism to remain in contact with the additional conveyor as the metallically augmented non-magnetic objects having the second level of magnetism traverse along the additional conveyor and as the non-magnetic objects slide off the additional conveyor in a direction that is perpendicular to a direction of travel of the metallically augmented non-magnetic objects having the second level of magnetism as the metallically augmented non-magnetic objects having the second level of magnetism remain in contact with the additional conveyor, the another magnetic force generator producing a different magnetic force relative to the magnetic force generator, wherein the conveying direction of the first conveyor is perpendicular to the conveying direction of the second conveyor and the additional conveyor, further wherein the second conveyor and magnetic force generator are disposed below the first conveyor; and a receptacle positioned below the additional conveyor that receives the non-magnetic objects from the additional conveyor.

2. The system according to claim 1, wherein the magnetic force generator is disposed below the second conveyor such that the magnetic force generated by the magnetic force generator holds the metallically augmented non-magnetic objects having the first level of magnetism in contact with the second conveyor.

3. The system according to claim 1, wherein the second conveyor and the magnetic force generator are attached to the frame.

4. The system according to claim 3, wherein the second conveyor and the magnetic force generator are disposed at an angle relative to a reference plane that extends through back struts of the frame.

5. The system according to claim 4, wherein the first and second conveyors are offset from one another.

* * * * *